US006981682B2

(12) United States Patent
Kind

(10) Patent No.: US 6,981,682 B2
(45) Date of Patent: Jan. 3, 2006

(54) SUPPORT DEVICE FOR DISPLAYING INDIVIDUAL BOOKS OR SIMILAR ITEMS

(76) Inventor: Paul Gerhard Kind, 391 Route 200, Russell, Ontario (CA) K4R 1E5

( * ) Notice: Subject to any disclaimer, the term of this patent is extended or adjusted under 35 U.S.C. 154(b) by 69 days.

(21) Appl. No.: 10/411,285

(22) Filed: Apr. 11, 2003

(65) Prior Publication Data

US 2003/0234333 A1 Dec. 25, 2003

Related U.S. Application Data

(60) Provisional application No. 60/374,616, filed on Apr. 23, 2002.

(51) Int. Cl.
*A47B 97/04* (2006.01)

(52) U.S. Cl. ..... 248/444; 248/300

(58) Field of Classification Search ..... 248/444, 248/455, 152, 174, 441.1, 459
See application file for complete search history.

(56) References Cited

U.S. PATENT DOCUMENTS

| | | | | | |
|---|---|---|---|---|---|
| 1,169,869 | A | * | 2/1916 | Richards | 248/453 |
| 1,812,318 | A | * | 6/1931 | Bower | 211/37 |
| 3,593,955 | A | * | 7/1971 | Hind | 248/448 |
| 3,809,352 | A | * | 5/1974 | Mathias | 248/444.1 |
| 3,897,037 | A | | 7/1975 | Johnson et al. | |
| 4,073,460 | A | * | 2/1978 | Dale | 248/441.1 |
| 4,150,807 | A | | 4/1979 | Manso | |
| 4,379,618 | A | * | 4/1983 | Tall | 359/804 |
| 4,610,416 | A | * | 9/1986 | Choi | 248/459 |
| D289,233 | S | * | 4/1987 | Cadman | D6/314 |
| 4,978,096 | A | | 12/1990 | Struckmann | |
| 5,106,047 | A | * | 4/1992 | Baer | 248/459 |
| 5,213,302 | A | * | 5/1993 | Rowe, Jr. | 248/459 |
| D358,144 | S | * | 5/1995 | Masaaki | D14/447 |
| 5,492,299 | A | | 2/1996 | Thermos et al. | |
| 5,639,053 | A | * | 6/1997 | Dmitriev | 248/460 |
| D388,263 | S | * | 12/1997 | Amerault | D6/419 |
| 6,129,323 | A | * | 10/2000 | Mandokoro et al. | 248/453 |
| 6,283,432 | B1 | * | 9/2001 | Hoose, Jr. | 248/441.1 |
| 2001/0030272 | A1 | * | 10/2001 | Moore | 248/441.1 |
| 2002/0171021 | A1 | * | 11/2002 | Goretti | 248/455 |

FOREIGN PATENT DOCUMENTS

| | | |
|---|---|---|
| CA | 19559/131 | 3/1954 |
| CA | 53099 | 7/1984 |
| CA | 69016 | 8/1991 |
| CA | 94411 | 1/2002 |

* cited by examiner

*Primary Examiner*—Kimberly Wood
*Assistant Examiner*—Amy J. Sterling
(74) *Attorney, Agent, or Firm*—Shapiro Cohen

(57) ABSTRACT

A support device for displaying individual objects, such as books in a readable position, comprises a backrest having a substantially planar upper portion having an upper edge and a substantially curved lower portion comprising a cradle having a free edge. A support means is adapted to support the upper portion whereby in operation the upper portion of the backrest is rearwardly inclined from the cradle, and object restraining means are affixed substantially perpendicular to the free edge of the cradle.

8 Claims, 2 Drawing Sheets

SUPPORT DEVICE FOR DISPLAYING INDIVIDUAL BOOKS OR SIMILAR ITEMS

CROSS REFERENCE TO RELATED APPLICATIONS

This application relates to U.S. application Ser. No. 60/374,616 filed Apr. 23, 2002.

BACKGROUND OF THE INVENTION

1. Field of the Invention

This invention relates to support devices for displaying objects, more particularly for supporting books or other reading materials in a readable position while leaving the hands of the reader free for other tasks.

2. Background of the Invention

Various devices are known for supporting individual books, magazines, papers and the like in a readable display position while leaving the hands of the reader free. Such existing devices include various backrest surfaces for supporting the back of the book or other material, such backrest surfaces being held in a generally rearwardly inclined position by a prop or similar rigid rear support, requiring the use of hinges or other fastening means to attach the prop to the backrest. Such devices generally include clamps, springs or similar movable parts to retain the pages of the book or other material in position on the backrest. These devices often are in the general configuration of a small version of a traditional artist's easel. Although such devices have been constructed in such manner as to be collapsible for storage, they remain cumbersome.

To retain a book or other material in place, prior art devices generally have a flat support at the lower front of the device, on which the lower portion of the book can rest, and retaining means as noted above. However, such structures suffer from the disadvantage of being suitable only for a small range of book depths, in that if the flat support on which the book rests is sufficiently deep for thicker books, thinner books cannot be securely retained. This problem can be addressed in part by the use of more sophisticated retaining means, such as spring loaded clamps, but these are generally complex and unwieldy. Further, although such prior art retaining means can achieve an increased effectiveness in securing the book or other material in a stable position, the increased size of the clamps or levers generally leads to the corresponding disadvantage of encroaching on, and thus obscuring part of, the printed area of the page being displayed.

An alternative construction is also known in which the book or other material is retained by fixed tabs at the front edge of the lower support area, where the backrest, lower support and tabs together form a narrow "U" configuration. However, although this construction results in a simpler form of retaining means, it nevertheless suffers from the disadvantage noted above of being suitable for only a small range of book thicknesses. Although a thicker book can be placed on the device with only the covers being secured behind the tabs, there is a disadvantage in that the pages of such a book would not be retained by the tabs and would require supplementary retaining means.

Other disadvantages of the prior art devices include the complexity of construction from numerous separate elements, including moving parts, and the resultant economic disadvantage.

It has been found that the above and other disadvantages of the prior art can be substantially overcome if the lower support for the base of the book or other material is made in the form of a cradle, having a generally broadly curved configuration at its lowest point, but extending forwards into a substantially flatter portion, to the front free edge of which retainer tabs are affixed substantially perpendicularly, thus providing a book support which is suitable for a significantly greater range of book thicknesses than has hitherto been feasible. By the use of this simple construction, retainer tabs can be provided to retain the displayed pages securely in the desired position, without obscuring the text. Various configurations can be used for the back support, or prop, for the backrest, but it has been found that the use of a broad flat prop integrally constructed with the backrest and angled therewith to form an inverted "V" is particularly effective to provide stability, and to urge the lower end of the book being supported into an optimal position in relation to the lower support and the tabs. Preferably, the lowest portion of the cradle substantially comprises an arc, the radius of which, when measured from the lowest point of the arc which rests on the table or other support surface, is at least equal to the vertical height of the front free edge of the cradle.

Thus the invention seeks to provide an improved display and support device for a book or other materials, suitable for a wide range of book heights, widths and depths, of a simple construction, with simple and effective retaining means to secure the pages of an opened book in a readable position while leaving the hands of the reader free for other tasks. The device of the invention can be constructed with a low profile, which results in it being compact, stable, readily transportable and convenient, while also being visually attractive. Further, the simplicity of construction results in economic advantages.

The invention further seeks to provide an improved display and support device for a book or other materials, wherein the entire device can be of unitary construction.

SUMMARY OF THE INVENTION

The invention seeks to provide an improved support device for displaying objects such as books or other reading materials in a readable position while leaving the hands of the reader free for other tasks. The device can also be used for displaying other objects, such as decorative items, within the same general size range as books.

In a first broad embodiment, the invention thus seeks to provide a support device for displaying objects, comprising a backrest having a substantially planar upper portion having an upper edge and a substantially curved lower portion comprising a cradle having a free edge; wherein the cradle comprises an arc having a radius at least equal to a vertical distance from a lowest point of the arc to the free edge of the cradle measured in an operating position of the support device; a support means adapted to support the upper portion whereby in operation the upper portion of the backrest is rearwardly inclined from the cradle; and object restraining means affixed substantially perpendicularly to the free edge of the cradle.

In a second broad embodiment, the support means is substantially planar and has an upper edge affixed to and substantially coterminous with the upper edge of the upper portion of the backrest. The support means and the backrest can be of an integral construction, and the lower edge of the support means can be provided with a planar strip adapted to contact and be supported by a horizontal surface on which the device might conveniently be placed.

In a third broad embodiment, the device is of a unitary construction, for example being constructed from suitably folding a predetermined and precut metal or plastic shape into the desired configuration.

BRIEF DESCRIPTION OF THE SEVERAL VIEWS OF THE DRAWINGS

The invention will now be described in detail with reference to the drawings in which.

DETAILED DESCRIPTION OF THE INVENTION

Figure 1:
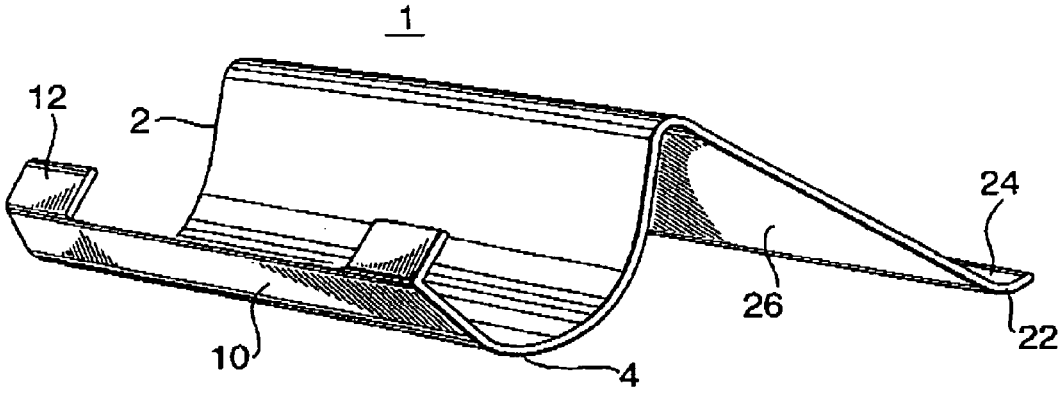
FIG. 1 is an isometric view of an embodiment of the invention.
Figure 2:
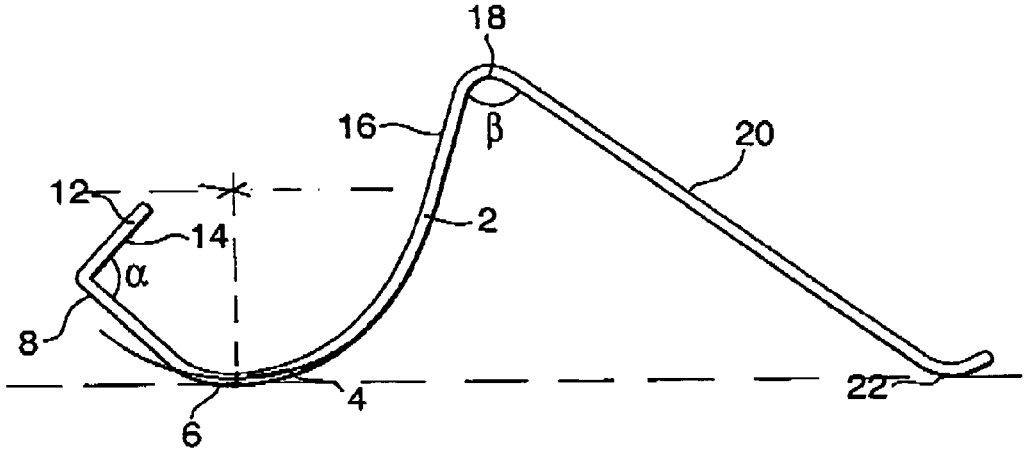
FIG. 2 is a side view of an embodiment of the invention.

Referring to FIGS. 1 and 2, a support device 1 comprises a backrest 2, having a substantially flat upper portion 16, and a lower portion comprising a cradle 4. The cradle 4 is substantially concavely curved on each side of its lowest point 6, which is adapted to rest on a support surface such as a table (not shown). As can be seen most clearly from FIG. 2, the concave curve of the cradle 4 substantially comprises an arc. Further, it can be seen that when the device 1 is placed in a normal operating position so that the lowest point 6 rests on a support surface (not shown), the radius of the arc is at least equal to the vertical height of the free front edge 10 (FIG. 1) from the support surface.

In a forward direction from the lowest point 6, the radius of curvature of the cradle increases through a substantially flat portion 8 towards a front edge 10. The backrest 2 is inclined rearwardly from the cradle 4, at an angle which is preselected so that the book or other item being supported will be at an appropriate angle for the comfort and convenience of the user.

Affixed at predetermined locations to the front edge 10 are tabs 12, the inside surfaces 14 of which form an angle $\alpha$ of approximately 90 degrees with the flat portion 8 of the cradle 4.

At the upper edge 18 of the upper portion 16 of the backrest 2, a suitable prop means 20 can be affixed, to form an internal angle $\beta$ with the backrest 2. Such prop means is preferably a substantially flat back support 26, having attached at its lower edge 22 a flat strip 24, for contacting a support surface such as a table (not shown). The angle $\beta$ is preferably within the general range of approximately 60 to 80 degrees.

Figure 3:
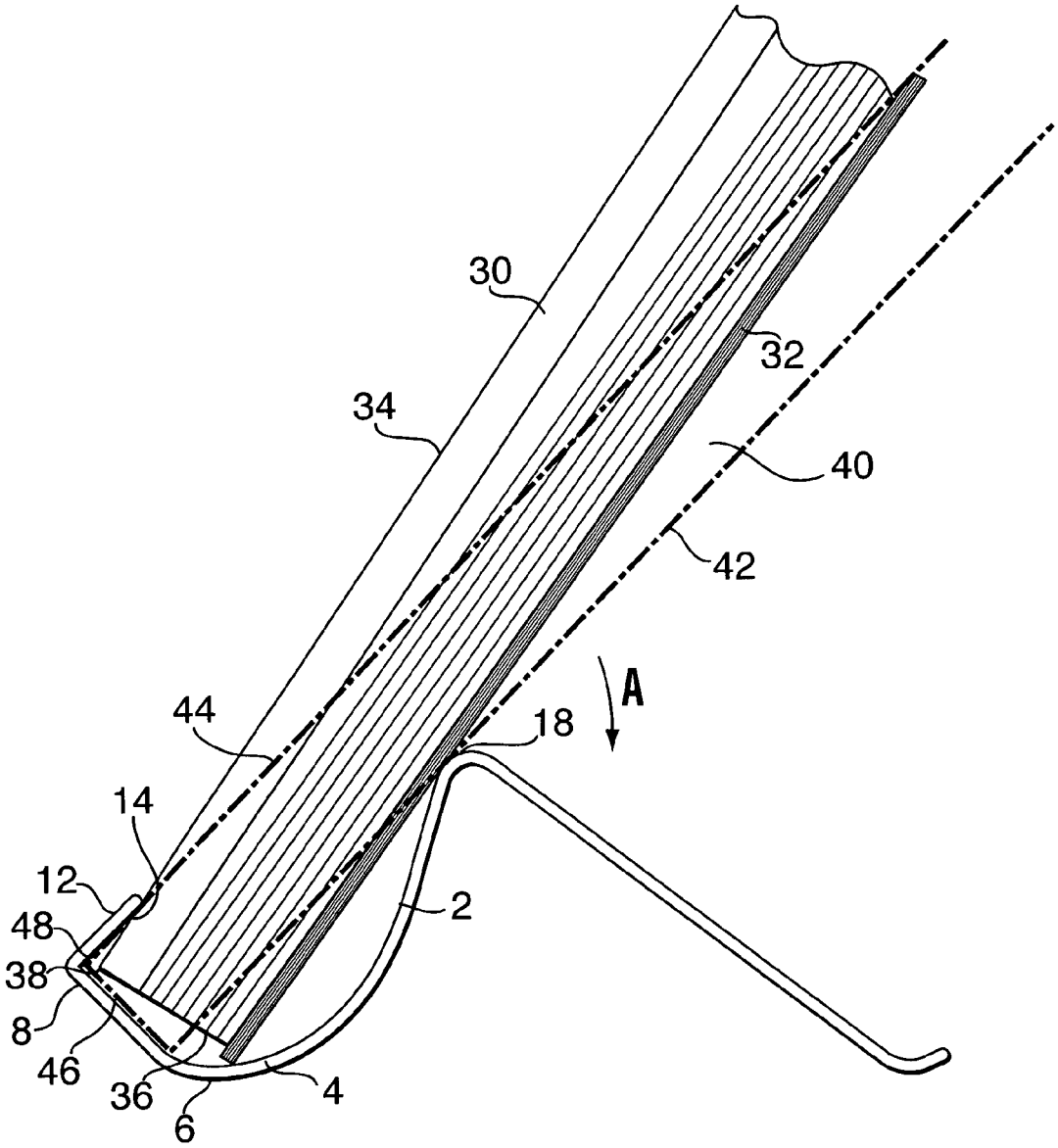
FIG. 3 is a side view of the device of FIG. 1 in use.

Referring to FIG. 3, a book 30 is held by the device 1 in an open, readable position. The back covers 32 of the book 30 rest on the backrest 2. As the book 30 is placed into the device 1, the book 30 rotates with gravity in the general direction shown by arrow A, and the back covers 32 slide downwards along the backrest 2, and the lower portion 36 of the book 30 moves towards a resting position within the cradle 4. As the lowest part of the back covers 32 slides towards or even beyond the lowest point 6 in the cradle 4, the distance between the point at which the lower part 38 of the exposed pages is in contact with the inside surfaces 14 of the tabs 12 and the point at which the lowest part of the back covers 32 contacts the cradle 4 steadily decreases, while the lower part 38 of the exposed pages at the front of the book 30 moves along the flat front portion 8 of the cradle 4, at least partly into the angle a, to be retained securely by the inside surfaces 14 of the tabs 12, so that the lower part 38 of the pages is thus gently restrained and the book 30 is held gently but securely in the stable position shown in FIG. 3.

It can readily be seen that the extent to which the lower part of the book 30 contacts the inside surfaces 14 of the tabs 12 will depend on the depth, or thickness, of the book 30 from the front 34 to the back 32. The book 30 shown in FIG. 3 is sufficiently thick to reach a stable position before the lowest part 38 of the front pages reaches the angle $\alpha$. However, for a thinner book 40, shown in part by ghost lines in FIG. 3, the back covers 42 will contact the upper edge 18 of the backrest 2 at a greater angle, the lower portion 48 of the exposed front pages 44 will be in contact with the tabs 12 along substantially the entire inner surface 14, and at least part of the lower portion 46 of the book 40 will be in contact with the flat front portion 8 of the cradle 4.

The device 1 can be constructed from various materials, including metals, plastics, preferably any which are readily suitable for folding and finishing by known methods to facilitate unitary construction of the device. Alternatively, decorative woods can be used for a desired visual effect.

Preferably all the edges of the device 1 are finished by one or more of sanding, grinding or milling, and optionally by the application of a protective coating to result in a smooth, preferably rounded surface, to prevent injury to the user or damage to the item being supported or to any horizontal support surface on which the device is placed, such as a table (not shown).

I claim:

1. A one piece support device for displaying objects comprising (a) a backrest having (i) a substantially planar upper support portion having an upper edge and (ii) a substantially curved lower portion comprising a cradle having a free edge, wherein the cradle comprises an arc continuous with and tangential to the planar upper portion, and having a radius at least equal to a vertical distance from a lowest point of the arc to the free edge of the cradle measured in an operating position of the support device, whereby said curved lower portion is able to accommodate display objects of many thicknesses;

(b) a support means adapted to support the upper support portion wherein the upper portion of the backrest is rearwardly inclined from the cradle; and (c) object restraining means integral with and substantially perpendicular to the free edge of the cradle.

2. A support device as claimed in claim 1 wherein the support means is substantially planar and has an upper edge affixed to and substantially coterminous with the upper edge of the upper support portion of the backrest.

3. A support device as claimed in claim 2, wherein the support means is integrally constructed with the upper support portion of the backrest.

4. A support device as claimed in claim 3, wherein a lower free edge of the support means comprises a substantially planar strip adapted to contact and be supported by a substantially horizontal support surface.

5. A support device as claimed in claim 1, wherein the restraining means comprise a plurality of tabs integrally constructed with the cradle.

6. A support device as claimed in claim 3, wherein the support device is of a unitary construction.

7. A support device as claimed in claim 4, wherein the support device is of a unitary construction.

8. A support device as claimed in claim 5, wherein the support device is of a unitary construction.

* * * * *